United States Patent [19]

Fink

[11] 4,018,022

[45] Apr. 19, 1977

[54] INSULATED FRAME ASSEMBLY

[75] Inventor: Frederick M. Fink, Barrington Hills, Ill.

[73] Assignee: Continental Aluminum Products Company, McHenry, Ill.

[22] Filed: Dec. 2, 1974

[21] Appl. No.: 528,677

Related U.S. Application Data

[63] Continuation-in-part of Ser. No. 335,624, Feb. 26, 1973, abandoned.

[52] U.S. Cl. ..... 52/398; 49/DIG. 1; 52/400; 52/732

[51] Int. Cl.[2] ..... E06B 3/62

[58] Field of Search ..... 52/212, 398, 400, 616, 52/732, 584; 49/DIG. 1

[56] References Cited

UNITED STATES PATENTS

| | | | |
|---|---|---|---|
| 2,831,553 | 4/1958 | Pollock | 52/400 |
| 2,928,144 | 3/1960 | Persson | 52/398 |
| 2,983,969 | 5/1961 | Muessel | 52/397 |
| 3,055,468 | 9/1962 | Horejs et al. | 52/403 X |
| 3,203,053 | 8/1965 | Lane et al. | 52/213 X |
| 3,204,324 | 9/1965 | Nilsen | 52/309 X |
| 3,213,980 | 10/1965 | Persson | 52/204 X |
| 3,289,377 | 12/1966 | Hetman | 52/403 X |

FOREIGN PATENTS OR APPLICATIONS

| | | | |
|---|---|---|---|
| 112,571 | 3/1968 | Norway | 49/DIG. 1 |

*Primary Examiner*—Alfred C. Perham
*Attorney, Agent, or Firm*—Darbo, Robertson & Vandenburgh

[57] ABSTRACT

An insulative frame-strip assembly comprises metallic inner and outer side members splined together by a rigidly-acting insulating or frost-barrier splicing strip. These three main parts are extrusions assembled by transverse movements, instead of being threaded end for end or requiring molding of the splicing strip in situ. Inadvertent disassembly in handling is prevented by locking made effective by a pressed-in locking strip. The locking may use interlocking formations or only friction, and either may be aided by torsional pressure. The locking strip is inserted through the pane-receiving channel so that inserting the pane therein prevents removal of the locking strip and adds to its locking forces. Hooked webs on the two metal side members extend transversely in slightly spaced parallel planes, the end of each being a flange extending toward the other web and snugly engaging the spline strip to use its compressive strength.

5 Claims, 6 Drawing Figures

INSULATED FRAME ASSEMBLY

This application is a continuation-in-part of application Ser. No. 335,624, filed Feb. 26, 1973, and now abandoned shortly after the filing of this application.

INTRODUCTION

The invention of which the present disclosure is offered for public dissemination in the event that adequate patent protection is available relates to the field of metallic frames for windows, doors or other structural elements whose inner and outer surfaces are normally exposed to temperature differentials and in which a problem is encountered in the cold climates due to the relatively high thermal conductivity of the metallic material. In such frames, it is necessary to insulate the surface of the frame exposed to the exterior from its interior-exposed surface to prevent the formation of condensate water, ice or frost on the interior surface during the cold months and also to prevent undue loss of heat. Many different structural configurations have been proposed in the past for achieving the required degree of insulation, but so far as known all of them have suffered from the disadvantages of being relatively complex, bulky or costly, and most require assembly by endwise threading of one part through another, or molding the insulative member in situ in the assembly.

Typical prior art approaches to the above-noted problem are disclosed in U.S. Pat. Nos. 3,289,377; 3,055,486; 3,213,980; 3,203,053; Norwegian Patent No. 112,571; and British Patent No. 799,233. In general these disclosures either require a plurality of splining insulating strips for each frame-strip or involve complex configurations that are relatively difficult to manufacture and install and are relatively costly and bulky. A commercial disclosure of a strip with molding in situ shows U.S. Pat. No. 3,204,324.

In accordance with this invention, however, the frame-strip structure has been significantly simplified by utilizing a slim, relatively rigid insulating spline strip in a rectilinear-serpentine configuration for engaging parallel overlapping hooked flanges of the two side members. This facilitates assembly by transverse movement, in which the final step may be pivoting the frame-strip elements into torsional interlocked positions. The spline strip thereafter functions both as an insulator or frost barrier and as a structural member for rigidly joining the interior and exterior side members together. The spline strip uses its compressing strength (acting jointly with shear strength in most forms) rather than being dependent upon its tensile strength.

Accordingly, one object of this invention is to provide an insulated frame-strip having a simplified structure.

A further object of this invention is to provide an insulated frame strip having a reduced cost.

An additional object of this invention is to provide an insulated frame which is easy to assemble and install.

Another object of this invention is to provide an insulated frame strip which has dependable permanence of strength due to using the compressive strength of the insulative portion thereof.

SUMMARY OF THE INVENTION

In accordance with this invention, the above-noted objects are atained by providing interior and exterior metallic side members, each having a hooked web that projects transversely from its side member toward the other side member, with the two hooked webs lying in parallel overlapped spaced relationship. Each hook flange engages a substantially noncompressible insulating spline strip lying between the two webs. This strip is dimensioned to fit snugly between the webs and is grooved on opposite sides to interlock as to lateral forces with the hooked flanges. The grooves make it of rectangular-serpentine cross section. An insulative, slightly compressible locking strip is interposed between web portions after assembly to lock the parts together while the channel for the member to be framed remains empty.

DESIGNATION OF THE FIGS.

INTENT CLAUSE

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

BACKGROUND DESCRIPTION

Figure 1:
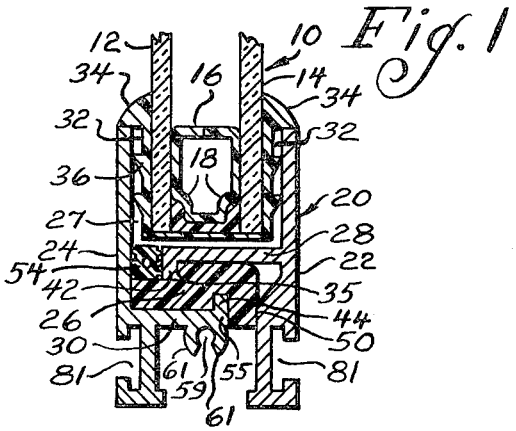
FIG. 1 is a fragmentary cross-sectional view of one illustrative frame of this invention adapted for use as a window sash.

In some respects the present invention is similar to prior framing for windows and the like. In fact, it has been illustrated as used for framing a thermal window 10 which has an interior pane 12 and exterior pane 14. To provide a sealed thermal window they are spaced apart and sealed to a frame-shaped peripheral spacer strip 16. Grooves 18 are provided along the opposite peripheral side edges of spacer strip 16 to receive the highly adhesive bonding and sealing mastic for securing the panes 12 and 14 to the peripheral strip 16. Although only a fragmentary cross section of the window 10 is shown in FIG. 1, it will be understood that the window is rectangular in shape and that the panes 12 and 14 are cemented to the peripheral spacer strips 16 around the entire window periphery.

A sash or frame extends around and embraces the four sides of the window 10, the numeral 20 being applied to the assembled strip on one side thereof. It is old to have each side strip of the sash or frame formed by some form of exterior and interior side members (here 22 and 24) joined together and separated in some way, not as shown, by a central plastic body (here 26)

which serves as insulation. A channel 27 of U shape in cross section is formed between the side members 22 and 24, the bottom of the U in this instance being formed mainly by the hook-shaped web 28 which, with its companion hook-shaped web 30, is described below as an important part of the invention. According to common practice, the window 10 is supported at its periphery within the U-shaped channel 27, and has liner strips 32 interposed between the window and the channel. Liner strips 32 are of resilient material with outwardly exposed longitudinal ribs 36 which resiliently seal against the inner faces of side members 22 and 24. Also compressibility of these ribs limit the spreading pressure which the window applies through them to the sides of U-shaped channel 27 as the strip assemblies 20 for all four sides are each separately pressed into place straddling its edge of the window 10. The exposed edges of liner strips 32 are formed with lips 34 which seal against the side members 22 and 24 and are sloped to shed water if positioned at the bottom of the window.

THE SPLICING OF THE PRESENT INVENTION

The present invention is concerned especially with the novel and simplified manner in which the side members 22 and 24 are spliced together. This is primarily accomplished by the plastic spline strip 26 and the hooked webs 28 and 30. The webs 28 and 30 are called hooked webs because they have flanges 42 and 44, each extending perpendicularly from its carrying web toward the other web. The hooked webs 28 and 30 are overlapping so that the hooked flanges 42 and 44 have oppositely facing inner-hook faces generally facing toward one another. Each of these inner-hook faces firmly engages a shoulder of the plastic spline strip 26 so that any spreading force tending to separate the side members 22 and 24 will place the plastic spline strip 26 under a compressive force as is readily apparent from FIG. 1, although in that figure shear forces are also relied upon. Thus, the splicing strength of the two members is not dependent upon the tensile strength of the plastic strip 26.

Figure 2:
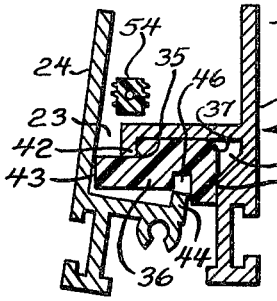
FIG. 2 is an exploded view of the embodiment shown in FIG. 1 being assembled.
Figure 4:
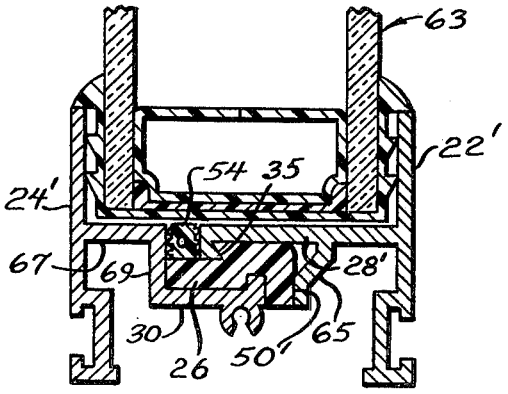
FIG. 4 is a fragmentary view of a second embodiment of the invention adapted for use as a window sash for a thicker window.

In FIGS. 1 and 2 the flange 42 has been illustrated with a return-pointed toe 35, and the engaging shoulder of the spline strip 26 is shaped with a corresponding undercut. This gives at least the appearance of a firmer splicing, but tests have shown that satisfactory results can also be obtained if the toe is omitted so that the flange 42 has parallel sides as illustrated in connection with flange 44. The toe 35 is also shown in FIG. 4, but projecting about twice as far as is preferred. The smaller toe has been found to be enough, its sloping face then extending about half way to the main body of web 28, the remaining face of flange 42 being perpendicular to web 28. Of course, the face of strip 26 conforms in any case.

From FIGS. 1 and 2 it may be seen that the frame stripping 20 can be assembled entirely by transverse movements of its parts, without need for endwise threading of one part into another. Avoiding the endwise threading is desirable in saving time and in reducing space requirements for assembly. If the toe 35 is provided, transverse assembly will require pivotal or rocking action to assemble the spline strip 26 to the member carrying the toe 35. The final rocking into position of the spline strip 26 may be aided by rounding or relieving corner 37 of splicing strip 26. However, this is not essential because with only minor force applied, the strip 36 can be rocked into place even though it may need to be "sprung" past the corner 39 of strip 22. The longitudinal groove 41 in strip 22 may both save metal and facilitate this step of assembly.

The assembly of side member 24 to the preassembled members 22 and 26 is probably most easily accomplished by the rocking or pivotal movement the start of which is illustrated in FIG. 2. The spline strip 26 is dimensioned so that its face 43, when rested against the cooperating face of inner side member 24 as shown in FIG. 2, will align the hook or flange 44 with groove 46 of spline strip 26, so that flange 44 slips easily into snugly fitting groove 46 by a slight rocking of the inner side member 24 with respect to the remainder of the assembly.

The final step of assembling the framing strip 20 is to press locking strip 54 into the gap 23, the locking strip 54 being slightly oversized so as to tend to spread the side strip 24 away from the flange 42. With the locking strip 54 in place, the assembly is quite firmly spliced so that it can be cut to length, and otherwise processed if necessary, to be assembled with other such cut-to-length strips. Each assembly is pressed onto one of the four edges of the window 10 and then joined to adjacent strip assemblies together to form a frame or sash.

In looking at FIGS. 1 and 2 it might seem that surely the assembled parts would fall apart quite easily. There seems to be no structural interlock, for example, which would prevent the side member 24 from being moved downwardly with respect to the remainder, thereby slipping the hooked flange 44 out from its place in groove 46. This does not occur, however, because of a very effective frictional interlock. The side member 22 is provided with a shoulder 50 which bears firmly on the plastic strip 26, making it substantially unyielding. The spreading force produced by locking strip 54 tends to rock the side strip 24 about the tip of its hook flange 4, but since that tip is also bearing firmly on the plastic strip 26, the slightest rocking movement is accompanied by a canting or torsional action which forces heel 55 of flange 44 against the portion of the plastic strip 26 which has been made unyielding by shoulder 50. High torsional pressure and frictional interlocking therefore develops. Again, referring to FIG. 2, it might seem that the inner side member 24 jointly with the spline strip 26 could easily be moved downwardly away from side member 22 if the toe 35 were not present. However, tests have shown that this is not so. The friction provided by locking strip 54 plus the friction provided by the thrust of the tip of flange 44 in compressive action toward flange 42 provided adequate friction in the test. The toe 35 provides a factor of safety, however, during the processing stage.

SEPARATION IMPOSSIBLE IN FULL FRAME

Figure 3:
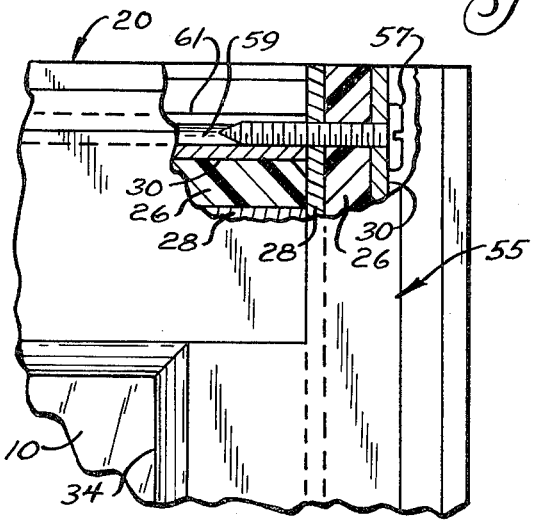
FIG. 3 is a fragmentary face view broken away to show two strip assemblies embodying this invention joined together at the corner of a window.

Once the full frame has been assembled, separation of the strip assemblies becomes impossible. The reason can be briefly stated that the corner joints, of whatever form, tie everything together. One form of corner joint is illustrated in FIG. 3 wherein it may be seen that the vertical member 55 has been milled out to receive the horizontal member 20. Of course, the member 20 is shown upside down as compared to FIG. 1. Holes have been drilled in the member 55 and a self-tapping screw 57 has been inserted through these holes and screwed into a screw socket in the form of slot 59 between two flanges 61. The head of the screw 57 bears on the peripherally-outer hooked web 30 of vertical frame strip 55. Inasmuch as screw 57 threads itself into the groove 59 of the corresponding peripherally-outer hooked web 30 of the horizontal frame strip 20, these two peripherally-outer frame strips are tied together so that nothing can move peripherally outward, away from the window 10. Of course the window itself prevents any part of the frame structure from moving in the opposite direction, peripherally-inwardly or toward the thermal pane 10.

WIDE-CHANNEL FRAME STRIPS

If it is desired to frame a thicker window or other structure than the window 10 of FIG. 1, it is merely necessary to provide side strips using the same splicing system but designed to provide a wider U-shaped channel than the channel 27 of FIG. 1. Thus in FIG. 4 a wider window 63 has been shown, nearly everything else being substantially the same except (1) hooked web 28′ has a greater transverse dimension, and has a downwardly extending flange 65 to provide the shoulder 50′ serving the same purpose as the shoulder 50 in FIG. 1; and (2) the hooked web 30 is carried by a support web 67 in the plane of web 28′ and having a leg 69 extending downwardly to the hooked web 30. The supporting web 67 and its leg 69 furnish a suitable surface against which the locking strip 54 may bear when it is squeezed in for its locking purpose. Of course this suitable surface could be provided by a separate web or rib, the web 30 then extending directly outward from side member 24′. This might be preferred with some sizes intermediate the sizes of FIGS. 1 and 4. FIG. 4 also shows a different shape of toe 35, but the FIG. 1 shape is preferred (if any toe is used), using slightly less metal and having been tested.

The side members represented by side members 22 and 24 of FIG. 1, or 22′ and 24′ of FIG. 4, may have an infinite variety of shapes, and may be frame structures other than those which frame around something, or which may have more than one spline strip for joining more than two metal strips. Preferably, all use the same spline strip so that it is interchangeable. Some of these structures are disclosed in the parent application, Ser. No. 335,624, now abandoned, which the present application is replacing, and the disclosure of which is incorporated herein by reference in the event that any details not expressly disclosed herein are needed. It is believed, however, that the present disclosure will prove adequate, and that it is more clear as to the inventive concept than when so many other details are included as are found in the parent application.

SPLICE WITH AUXILIARY INSULATIVE STRIP

Figure 5:
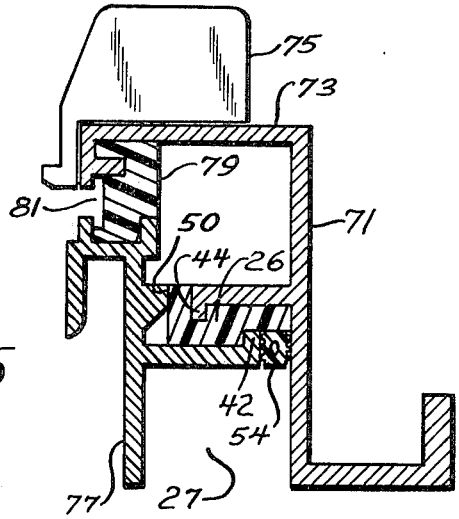
FIG. 5 is a fragmentary cross-sectional view of one use of the invention where an auxiliary insulative strip is also used.

The splice of the present invention can also be used in situations where a second insulative strip is needed, for example in a situation such as that illustrated in FIG. 5. This figure happens to be inverted as compared to some other figures, and hence the inside side member 71 is shown on the right, and the channel 27 for receiving the glass pane assembly is at the bottom. In this instance, it is desired to have a metal face 73 extending transversely of the plane of the glass. This could be desirable either for mere esthetic reasons, or to support a lock 75. It would not be desirable to have the transverse wall 73 engage the metal of the outside strip 77 because the resulting thermal conductivity would defeat the insulating purpose of the splicing strip 26. Accordingly, an auxiliary insulative strip 79 is provided. This need not prevent assembly of the parts by transverse movement. Before the locking strip 54 is pressed in, the side member 77 may be moved edgewise upwardly from just below its position shown in full lines. The fit at point 50 may be slightly loose to permit this movement, if necessary, with possible loss of the torsional pressure at point 50. The hooked flange 42 does not have the toe shown in FIGS. 1 to 3 because this would interfere with the described assembly. The flange 44 could have such a toe, however, at least if endwise insertion of that strip is deemed acceptable. It will be observed that the auxiliary insulative strip 79 is shaped to cooperate with members 71 and 77 to provide a T-shaped slot 81 to receive a weather strip such as wool pile weatherstripping. Other weather-strip slots 81 are shown in other figures.

The use of the auxiliary insulative strip 79, generally as illustrated in FIG. 5, although not specifically claimed, is shown so that if such a form becomes the preferred mode of use of the present invention, it will be disclosed as may be required by statute.

EARLY FORM OF INVENTION

Figure 6:
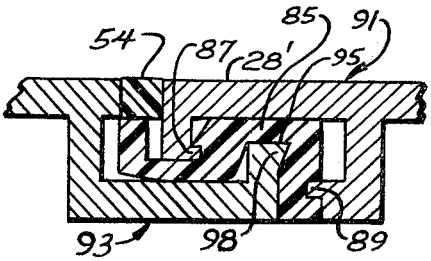
FIG. 6 is a fragmentary cross-sectional view which illustrates an early form of the invention.

FIG. 6 illustrates an early form of the invention, not now preferred. The chief difference between the structure of FIG. 6 and the splicing structure of the other figures probably is that the splicing strip 85 of FIG. 6 would have to be sprung into place (unless fed endwise) because of the toes 87 and 89 which provide structural interlocking. It should be understood that although the material of the locking strips 26 and 85 is substantially noncompressible, it has some minor degree of elastic flexibility expected to permit it to be sprung into place in side member 91 by transverse movement. Of course, this would be before assembly of the second side member 93 to the remainder. The groove 95 in the splicing strip 85 should be so shaped that after snapping the splicing strip 85 into the side member 91, the outwardly toed flange 98 could be inserted into slot 95 by transverse movement, with or without some rocking action of the side member 93. Of course, as a final step of assembly, the locking strip 54 would be squeezed into its gap in alignment with the hooked web 28′ of side member 91.

It will be observed that when structural interlocks at 87, 89 and 98 in FIG. 6 and at 35 in FIG. 1 are used, firmness of the assembly during processing is not dependent solely upon friction. It has been found, however, that these structural interlocks (not shown in FIG. 5) can be omitted in general. Even when all are used, as in FIG. 6, the high torsional pressure previously described may be helpful.

FURTHER DETAILS

All of the strips 22, 24, 26 and 54 are extrusions.

One suitable material for the spline strip 26 is a weatherstrip grade of polyvinyl chloride such as that available from B. F. Goodrich as "Geon" 87341. This material happens to suffer some reduction of tensile strength with age, but that is of no consequence because the present invention relies on shear and/or compressive strength, and both of these appear not to deteriorate. Hardness increases slightly.

For locking strip 54, conventional polysulfide screen locking strip used heretofore with fiberglass screening has been found to be suitable.

The hook flanges 42 and 44 may have varied lengths. The overlapping of FIG. 6 has been found to be unnecessary, nor do these flanges even need to reach a common transverse plane. It is probable, however, that they should not depart too greatly from reaching such a common plane. In other words, the plane through their nearest corners should make a sufficiently narrow or acute angle with the transverse planes perpendicular to the plane of the window so that the assembled strips, before the joining together as in FIG. 3, will have sufficient firmness and reliability of staying assembled, as in the shape shown.

ACHIEVEMENT

From the foregoing it is seen that a very simple construction for insulative metal-faced frame-stripping has been provided which permits assembly by transverse movements, provides firmness of the assembly for processing, uses the compressive strength of the plastic splice strip to hold the parts together and to ensure adequate sealing pressure on a framed window, is adaptable for a wide variety of structures, and permits interchangeability of parts, so that inventories often need not be as large as would be required without interchangeability.

I claim:

1. A frame strip assembly comprising laterally spaced side walls forming a channel between parallel edge zones thereof to receive a member to be framed, and interlocking means positioned to leave said channel free and including webs extending inwardly relative to the side walls, said webs including closely spaced overlapped portions, narrow flanges on the ends of the overlapped web portions, each flange projecting toward the web portion on which the other flange is formed and presenting a steep locking shoulder approximately opposing the shoulder of the other flange, a rigid spline strip in said space grooved from opposite sides to receive said flanges, a gap between the end of the one of the webs closest to said channel and a portion rigid with the side wall on which the other web is formed and which, when unfilled, permits pivoting of the said side walls toward and away from each other to facilitate relative transverse movement of the parts into an assembly from fully separated positions to a position for interlocking of the said spline strip with the overlapped web portions and flanges, and a locking strip in said gap dimensioned to hold said walls spread apart to the limit permitted by the spline strip and of sufficient compressive strength to lock said assembly while said channel remains empty.

2. A frame strip assembly as defined in claim 1 wherein the gap is between one of said flanges and an adjacent rigid surface, said locking strip being made of a material which has a relatively low thermal conductivity and is sufficiently rigid to maintain its dimensional stability under the compressive stress developed between said flange and said rigid surface.

3. A frame strip assembly comprising laterally spaced side walls forming a channel between parallel edge zones thereof to receive a member to be framed, and interlocking means positioned to leave said channel free and including webs extending inwardly relative to the side walls, said webs including closely spaced overlapped portions, narrow flanges on the ends of the overlapped web portions, each flange projecting toward the web portion on which the other flange is formed and presenting a steep locking shoulder approximately opposing the shoulder of the other flange, a substantially noncompressible spline strip in said space grooved from opposite sides to receive said flanges and hold them spaced apart, a gap between the end of the one of the webs closest to said channel and a face portion rigid with the side wall on which the other web is formed and which, when unfilled, permits freedom of relative movement of said side walls to facilitate relative transverse movement of the parts into an assembly from fully separated positions to a position with the overlapped web portions and flanges closed against the spline strip, and a locking strip in said gap dimensioned to hold said walls spread apart to the limit permitted by the spline strip and of sufficient compressive strength to lock said assembly while said channel remains empty.

4. A frame strip assembly comprising laterally spaced side walls forming a channel between parallel edge zones thereof to receive a member to be framed, and interlocking means positioned to leave said channel free and including webs extending inwardly relative to the side walls, said webs including closely spaced overlapped portions, narrow flanges on the ends of the overlapped web portions, each flange projecting toward the web portion on which the other flange is formed and presenting a steep locking shoulder approximately opposing the shoulder of the other flange, a substantially noncompressible spline strip in said space grooved from opposite sides to receive said flanges and hold them spaced apart, a gap between the end of the one of the webs closest to said channel and a face portion rigid with the side wall on which the other web is formed; said gap being accessible through the empty channel and, when unfilled, permitting freedom of relative movement of said side walls to facilitate relative transverse movement of the parts into an assembly from fully separated positions to a position with the overlapped web portions and flanges closed against the spline strip; and a locking strip in said gap dimensioned to hold said walls spread apart to the limit permitted by the spline strip and of sufficient compressive strength to lock said assembly while said channel remains empty.

5. A set of two elongate side members with hook-shaped webs and an elongate complementary shaped splicing strip, jointly adapted to form, with an elongate locking strip, an insulated frame strip assembly by movements of these parts transversely of their lengths into engagement with one another along their lengths, to form an assembly having a U-shaped channel between the side members to receive a unit to be framed and in which the spreading force exerted between the side members, when said unit is inserted in said channel, is resisted by compression forces on the splicing strip, said assembly being characterized by:

each of said side members having a longitudinally extending base portion including a side face bar, and having coupling means formed thereon for extending transversely toward the other when assembled, each coupling means including only a hook-shaped web consisting of a shank portion extending from the base portion generally perpendicular to its length, and a flange portion generally perpendicular to the shank portion; proportioned to permit assembly of said parts by movement thereof transversely of their lengths and for the shank portions when assembled with said splicing strip to be in overlapping and closely spaced relationship with a slab-like body of the splicing strip snugly between them, with each flange extending generally perpendicular to its shank toward the other shank to form a face facing its supporting base portion, with said body of the splicing strip located between and snugly engaging said faces of the two flanges to resist said spreading force other than by tensile strength of the splicing strip; the dimensions of each flange being so small as compared to the matching gap of the other side member as to be well spaced from parts of said other side member during said transverse assembly;

the shank of one of said side members being proportioned to form between it and the other side member after assembly a gap narrower than said channel, and said locking strip being insertable, after said assembly of the side strips and splicing strip, through said channel into said gap to be compressed independently of said unit between the side members in a position to apply a spreading force similar to that exerted by said unit whereby the flanges are then tightly engaged to the splicing strip to resist separation of the side members during processing.

* * * * *